US010264862B2

(12) United States Patent
Makuyana et al.

(10) Patent No.: US 10,264,862 B2
(45) Date of Patent: Apr. 23, 2019

(54) CASE CONVERTIBLE INTO A BABY CARRIER

(71) Applicant: Thokozani Nokuzola Anne Makuyana, Craigavon (ZA)

(72) Inventors: Thokozani Nokuzola Anne Makuyana, Craigavon (ZA); Pieter Etienne Dreyer, Edenvale (ZA); David Paul Stievenart, Greenstone (ZA)

(73) Assignee: Thokozani Nokuzola Anne Makuyana, Craigavon (ZA)

( * ) Notice: Subject to any disclaimer, the term of this patent is extended or adjusted under 35 U.S.C. 154(b) by 0 days.

(21) Appl. No.: 15/537,816

(22) PCT Filed: Nov. 18, 2015

(86) PCT No.: PCT/ZA2015/000067
§ 371 (c)(1),
(2) Date: Jun. 19, 2017

(87) PCT Pub. No.: WO2016/086240
PCT Pub. Date: Jun. 2, 2016

(65) Prior Publication Data

US 2017/0347763 A1 Dec. 7, 2017

(30) Foreign Application Priority Data

Nov. 26, 2014 (ZA) ..... 2014/08701

(51) Int. Cl.
*A47D 7/00* (2006.01)
*A47D 13/02* (2006.01)
(Continued)

(52) U.S. Cl.
CPC ..... *A45C 9/00* (2013.01); *A45C 5/08* (2013.01); *A47D 9/005* (2013.01); *A47D 9/02* (2013.01);
(Continued)

(58) Field of Classification Search
CPC ..... A47C 9/00; A45C 5/08; A45C 2009/002; A47D 9/005; A47D 9/02; A47D 13/02; A47D 15/00; A47D 7/00; A61G 11/006
See application file for complete search history.

(56) References Cited

U.S. PATENT DOCUMENTS 2,502,486 A * 4/1950 Savrin ..... A45C 9/00 190/1
3,259,285 A * 7/1966 Bush ..... A45C 13/26 224/578
(Continued)

FOREIGN PATENT DOCUMENTS

CN 2524455 12/2002
CN 2719666 8/2005
(Continued)

OTHER PUBLICATIONS

International Search Report and Written Opinion in International Application Serial No. PCT/ZA2015/000067 dated May 13, 2016.

*Primary Examiner* — Nicholas F Polito
*Assistant Examiner* — Rahib T Zaman
(74) *Attorney, Agent, or Firm* — Haugen Law Firm PLLP

(57) ABSTRACT

This invention relates to a case convertible into a baby carrier. More specifically, the invention relates to a device convertible between a baby carrier and a case. The device comprises a pair of shell members (12, 14) being angularly displaceable relative to one another between an open baby carrier condition and a closed case condition. The device further comprises a closure member (16) for locking the shell members (12, 14) in the closed condition with the closure member (16) providing storage space in which baby caring articles can be stored.

19 Claims, 7 Drawing Sheets

(51) Int. Cl.

| | |
|---|---|
| ***A47D 9/00*** | (2006.01) |
| ***A45C 9/00*** | (2006.01) |
| ***A45C 5/08*** | (2006.01) |
| ***A47D 9/02*** | (2006.01) |
| ***A47D 15/00*** | (2006.01) |

(52) U.S. Cl.
CPC ..... *A47D 13/02* (2013.01); *A47D 15/00* (2013.01); *A45C 2009/002* (2013.01)

(56) References Cited

U.S. PATENT DOCUMENTS

| | | | | | |
|---|---|---|---|---|---|
| 4,198,718 | A * | 4/1980 | Ballard | A01K 1/0353 | 119/499 |
| 4,371,206 | A * | 2/1983 | Johnson, Jr. | A47D 13/102 | 294/140 |
| 4,634,175 | A * | 1/1987 | Wise | A47D 1/002 | 297/183.3 |
| 4,999,863 | A | 3/1991 | Kane | | |
| 5,105,335 | A * | 4/1992 | Honda | H01L 21/67353 | 16/445 |
| 5,223,844 | A | 6/1993 | Mansell et al. | | |
| 5,431,478 | A * | 7/1995 | Noonan | A47D 13/025 | 297/130 |
| 5,470,039 | A * | 11/1995 | Hilger | A47D 5/006 | 248/164 |
| 5,540,365 | A * | 7/1996 | LaMair | A47D 13/02 | 224/158 |
| 6,166,627 | A | 12/2000 | Reeley | | |
| 6,851,136 | B2 * | 2/2005 | Brereton | A47D 9/005 | 135/126 |
| 7,037,205 | B1 * | 5/2006 | Bowman | A47D 13/02 | 297/183.1 |
| 7,389,897 | B2 * | 6/2008 | Pistiolis | A45C 9/00 | 224/158 |
| 7,661,158 | B2 * | 2/2010 | Daeseleire | A47C 21/026 | 297/354.13 |
| 8,297,399 | B2 | 10/2012 | Goi | | |
| 8,528,797 | B2 * | 9/2013 | Templeton | A61G 1/00 | 224/158 |
| 8,627,520 | B1 * | 1/2014 | Morton | A47D 9/005 | 190/2 |
| 8,777,311 | B1 * | 7/2014 | Laurel, Jr. | A47D 1/00 | 297/217.3 |
| 9,032,572 | B1 * | 5/2015 | Leach | A47D 15/003 | 5/655 |
| 9,743,778 | B2 * | 8/2017 | Garritt | A47D 13/02 | |
| 2005/0224547 | A1 * | 10/2005 | Krulik | A45C 13/30 | 224/578 |
| 2007/0102078 | A1 * | 5/2007 | Shimp | A45C 13/02 | 150/113 |
| 2009/0114691 | A1 * | 5/2009 | Bizzell | A45C 9/00 | 224/577 |
| 2009/0193582 | A1 * | 8/2009 | Kummerfeld | A47D 9/005 | 5/102 |
| 2014/0311843 | A1 * | 10/2014 | Grignon | A45C 9/00 | 190/2 |
| 2015/0039174 | A1 | 2/2015 | Takahashi et al. | | |
| 2015/0250329 | A1 * | 9/2015 | Murray | A47D 9/02 | 5/101 |

FOREIGN PATENT DOCUMENTS

| | | |
|---|---|---|
| CN | 201446934 | 5/2010 |
| CN | 101938472 | 1/2011 |
| CN | 202533984 | 11/2012 |
| CN | 102867393 | 1/2013 |
| CN | 102890834 | 1/2013 |
| CN | 202855044 | 4/2013 |
| CN | 203397479 | 1/2014 |
| CN | 103632492 | 3/2014 |
| DE | 10148993 | 5/2003 |
| DE | 102008007663 | 8/2009 |
| EP | 1680988 | 7/2006 |
| GB | 1166676 | 10/1969 |
| GB | 2283670 | 5/1995 |
| JP | 2000211478 | 8/2000 |
| JP | 2002279464 | 9/2002 |
| JP | 2003036493 | 2/2003 |
| JP | 2005239079 | 9/2005 |
| JP | 2006213306 | 8/2006 |
| JP | 2009126220 | 6/2009 |
| KR | 100761418 | 9/2007 |
| KR | 20090021563 | 3/2009 |
| KR | 101306068 | 9/2013 |
| KR | 101382498 | 4/2014 |
| KR | 20140053453 | 5/2014 |
| SE | 9702731 | 1/1999 |
| WO | 03025863 | 3/2003 |
| WO | 2006131346 | 12/2006 |

* cited by examiner

CASE CONVERTIBLE INTO A BABY CARRIER

BACKGROUND OF THE INVENTION

THIS invention relates to a case convertible into a baby carrier. More specifically, the invention relates to a device convertible between a baby carrier and a case, the device being angularly displaceable between an open baby carrier condition and a closed case condition, the device having a closure member for locking the device in the closed condition with the closure member providing storage space in which baby caring articles can be stored.

Devices convertible between different conditions, and in particular convertible between bag or case like and bed-like conditions are known. One such device is taught by SAVRIN in US patent document no. 2502486, which device is in the form of a soft traveling case capable of folding out into a bed for a baby or infant.

A first disadvantage of SAVRIN is that the device has no internal storage space for carrying baby caring articles other than the space in which a baby or infant will be laid down in, in the bed condition. Accordingly, this requires a parent to tediously pack and/or unpack the loose articles as the case is configured between the case like and bed-like conditions.

A second disadvantage of SAVRIN is that being a soft case, the device is not conducive to being used as a baby carrier in which a baby received therein is portable. Rather, the device requires a rigid surface on which it is supportable in a flat condition to act as bed.

A third disadvantage of SAVRIN is that with the device being soft and supportable in a flat condition, the device is not capable of a soothing rocking motion, which most babies require to be lulled to sleep.

Hard shell cases pivotally convertible into bed-like conditions are also known. For example, MYKKO NV in Japanese patent document no. 2006192274, MADISON in US patent document no. 5926881 and SUZHOU ZHENGZHIHUN PATENTED TECHNOLOGY SERVICES CO LTD in Chinese patent document no. 102860645 all disclose versions of such hard shell devices.

It will be appreciated that for such hard shell devices to be configurable into a bed-like condition, the pivoted walls at which a case are normally pivotal in a clam-like fashion must be removed entirely (i.e. open end shells) or movable such that it the bed-like condition, a single cavity is defined for receiving a baby or infant.

MYKKO NV and MADISON both appear to disclose hard shells having open ends to enable pivotally opened shell members to be configured into a bed-like condition. In the closed case like condition, these open ends are closed off by a soft flap-like member. As a result, the weight that can be accommodated in the case is limited by the weight the flap-like member can handle, with the open end furthermore being rendered unusable closing it in this fashion.

SUZHOU ZHENGZHIHUN PATENTED TECHNOLOGY SERVICES CO LTD appears to disclose hard shells having pivotally movable pivoted walls that, with the hard shells pivotally opened into the bed-like condition, are movable towards the inner sidewalls of the hard shells to define a single cavity into which a baby is receivable.

All three of the abovementioned hard shell devices suffer from the same disadvantage as the first disadvantage of SAVRIN. MADISON attempts to resolve the problem with a removable storage draw on a sidewall of one the hard shell, which although impractical, eliminates the need for loosely storing the required baby caring articles.

Furthermore, all three of the hard shell devices opened into the bed-like condition are supportable on a substantially flat surface, and accordingly incapable of imparting a rocking motion to the baby.

It is an object of the present invention to provide a device convertible between a baby carrier and a case that addresses the disadvantages of the known prior art devices.

SUMMARY OF THE INVENTION

According to the invention there is provided a device convertible between a baby carrier and a case including:

- a pair of shell members each defining a cavity delimited by walls thereof, an open end being defined by first peripheral edges of the walls of the shell member and an open side defined by second peripheral edges of the walls of the shell member;
- wherein the open end and the open side are adjacent one another, and further wherein the shell members are angularly displaceable relative to one another between:
  - an open baby carrier condition, wherein the open ends of the shell members lie substantially end-to-end relative to one another such that the second peripheral edges of the shell members jointly form a primary substantially closed loop peripheral edge defining a primary opening through which a baby is operatively receivable in the device in the baby carrier condition; and
  - a closed case condition, wherein the open sides of the shell members lie substantially side-to-side relative to one another such that the first peripheral edges of the shell members jointly form a secondary substantially closed loop peripheral edge defining a secondary opening; and
- a closure member releasably connectable within the secondary opening thereby to lock the shell members in the closed case condition.

The shell members may be shaped to substantially resemble a quarter of a hollowed sphere. Alternatively, the shell members may be shaped to substantially resemble a quarter of a hollowed cuboid.

In one embodiment of the invention, the cavity of each of the shell member may be delimited by: (i) a base wall; (ii) opposing sidewalls extending outwardly from the base wall, (iii) an end wall extending outwardly from the base wall and located between the opposing sidewalls; (iv) the open end substantially opposite the end wall, wherein the first peripheral edges defining the open end are those of the sidewalls and the base wall jointly; and (v) an open side substantially opposite the base wall, wherein the second peripheral edges defining the open side are those of the sidewalls and end wall jointly.

The base wall, opposing sidewalls and/or the end wall may be integral with one another. Furthermore, the base wall, opposing sidewalls and/or the end wall may be blended into one another to provide the shell members with a curving, rounded and flowing form such that in the open baby carrier condition; the device comprises a convex operatively bottom support surface on which the device can in use rock to lull a baby to sleep.

Preferably, each of the shell members are shaped to substantially resemble a quarter of a hollowed ellipsoid. More preferably, the device, with the shell members in the closed case condition and with the closure member connected within the secondary opening; is substantially ovoid in shape (i.e. egg-shaped).

In the open baby carrier condition, the first peripheral edges of the shell members may be within close proximity of one another and/or abut and further wherein, in the closed case condition, the second peripheral edges of the shell members are within close proximity of one another and/or abut.

The device preferably includes means for releasably locking the shell members to one another in the open baby carrier condition. The releasable locking means may take many different forms including clip formations located on the first peripheral edges of the shell members, or co-operative locking members on the respective shell members.

Typically, the first peripheral edges of each of the shell members lie on a first plane with the second peripheral edges lying on a second plane, the first and second planes being transversally orientated relative to one another. Preferably, the first and second planes are orientated substantially perpendicularly relative to one another.

Generally, the shell members are angularly displaceable relative to one another about a pivot axis passing across the opposing sidewalls of the shell members and lying substantially at or near the intersection of the first and second planes.

In a particularly preferred embodiment, the shell members are pivotally connected to one another by first and second pivot connections at each of the opposing sidewalls thereof.

Each of the pivot connections may include:

a pivot pin;

a pair of first pivot formations extending from each of the opposing sidewalls of one of the shell members, each of the first pivot formations defining an aperture for receiving the pivot pin; and a pair of second pivot formations extending from each of the opposing sidewalls of the other of the shell members, each of the second pivot formations adapted to capture a free end of the pivot pin passing through the respective first pivot formation thereby to enable the shell members to pivot with respect to one another about the pivot pins.

Typically, the free ends of the pivot pins are pointed outwardly from the device in opposite directions, with inwardly pointed opposite ends thereof connected to one another by a handle, the handle being movable relative to either of the shell members between a first position, wherein the handle is angularly displaceable to lie substantially adjacent the second peripheral edge of one of the shell members, and a second position, wherein the handle is angularly displaceable away from the second peripheral edges of the shell members.

Generally, the handle in the first position lies over or inside of the second peripheral edge of the respective shell member. In the second position, the handle may be substantially perpendicular to the second plane, the handle being releasably lockable at a plurality of angles relative to the second plane by a friction lock acting between the pivot pins, handle and/or shell members.

At least one of the shell members may comprise attachment formations on each of the opposing sidewall thereof for attaching a strap-like handle thereto.

Preferably, the attachment formations are captured within and capable of riding along slots defined in the opposing sidewalls such that the strap-like handle is configurable relative to the device between an inoperable position and an operable position.

In the inoperable position, the attachment formations are movable towards the pivot axis such that the strap-like handle is pulled towards and/or against the shell member. In the operable position, the attachment formations are movable away from the pivot axis such that a space is defined between a looped end of the strap-like handle and the end walls of the shell members thereby enabling a user to carry the device, in the closed case condition, over his/her shoulder.

Generally, the attachment formations are biased toward the inoperable position.

Typically, inner surfaces of the shell members are at least partially laid with bedding material.

The closure member may comprise a tertiary substantially closed loop peripheral edge adapted to abut the secondary substantially closed loop peripheral edge of the shell members in the closed case condition.

Generally, the closure member defines a plurality of storage compartments for storing feeding bottles, nappies and any other accessories. One or more of the storage compartments may comprise closures for opening and/or closing the respective compartment, and/or are insulated for keeping feeding bottles at the required temperature.

Typically, the closure member defines snap fit connecting formations for engaging the first and second pivot connections thereby to releasably connect the closure member in the secondary opening.

Preferably, the snap fit connecting formations are first and second pairs of connecting arms spaced from one another across the closure member, the connecting arms of each respective pair having free ends for engaging the respective pivot connections. The closure member may define a pair of opposing recesses therein to at least partially accommodate the pivot connections with the closure member connected within the secondary opening.

In another embodiment of the invention, the device may include means for generating a rocking motion of the device in the baby carrier condition.

Generally, the rocking motion generating means is in the form of one or more weights being movable within the device between the opposing end walls of the shell members with the device in the open baby carrier condition.

Typically, the device includes one or more speakers for playing music from a built-in audio player or from an external audio player to which the device is connectable via hardwire or wirelessly.

For charging an on-board power supply and/or for hardwire audio connection, the device may also include one or more ports for receiving connectors. Furthermore, the device may include a means of heating one or more of the feeding bottle storage compartments.

Generally, the device includes a controller for controlling the rocking motion generating means, the audio play and/or the heating means, the controller being a built-in control panel or an external control device.

Typically, the external audio player and the external control device are one and the same mobile communications device, preferably interfaced with the device via a downloadable software application.

BRIEF DESCRIPTION OF THE DRAWINGS

The invention will now be described in more detail, by way of example only, with reference to the accompanying drawings in which.

DETAILED DESCRIPTION OF THE DRAWINGS

Figure 1:
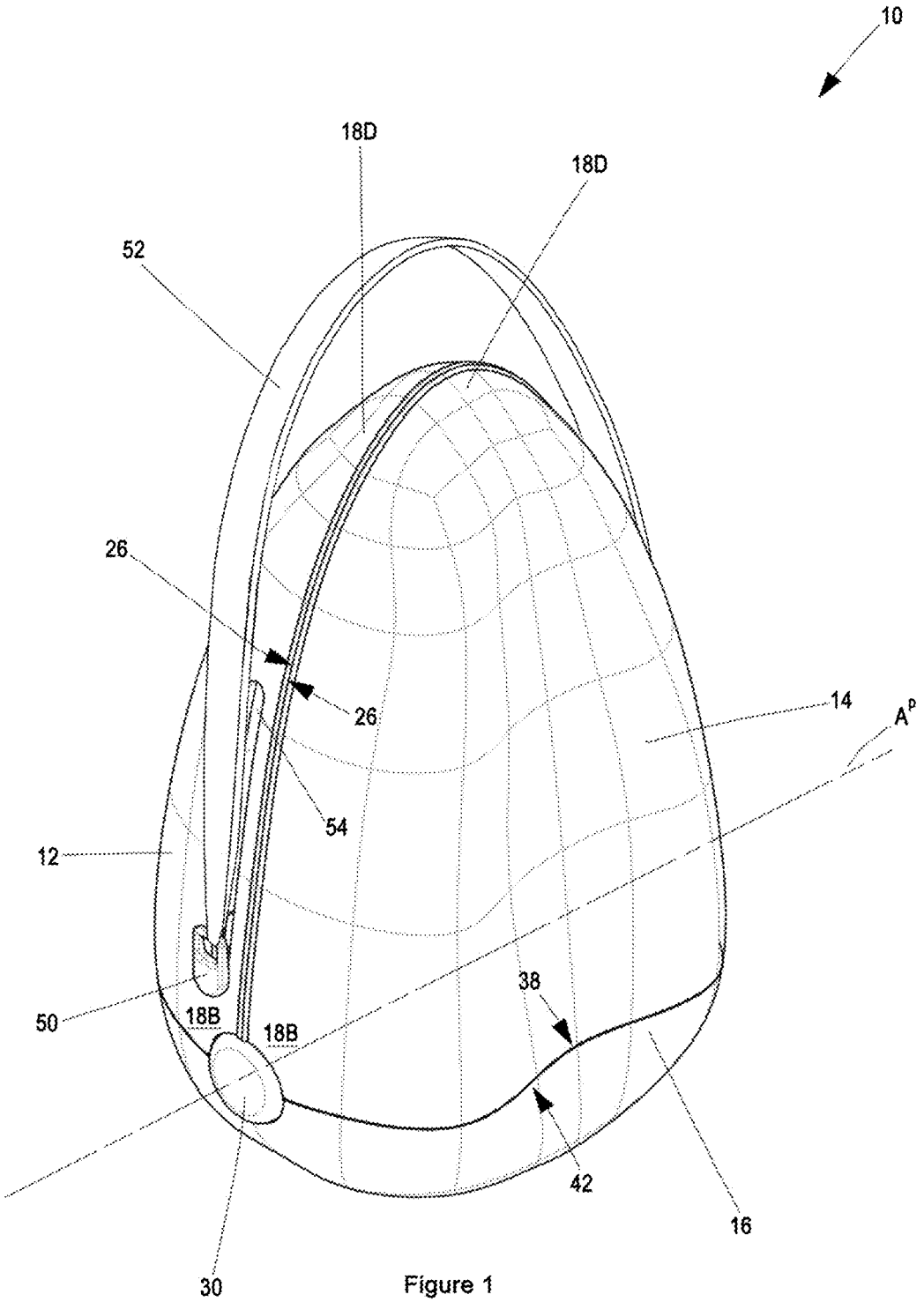
FIG. 1 is a perspective view of a device convertible between a baby carrier and a case in accordance with the present invention, illustrated with the device in a closed case condition.

A device according to an embodiment of the invention is designated generally in with reference numeral 10 in FIG. 1. The device 10 includes a pair of shell members 12, 14 and a closure member 16.

Figure 2:
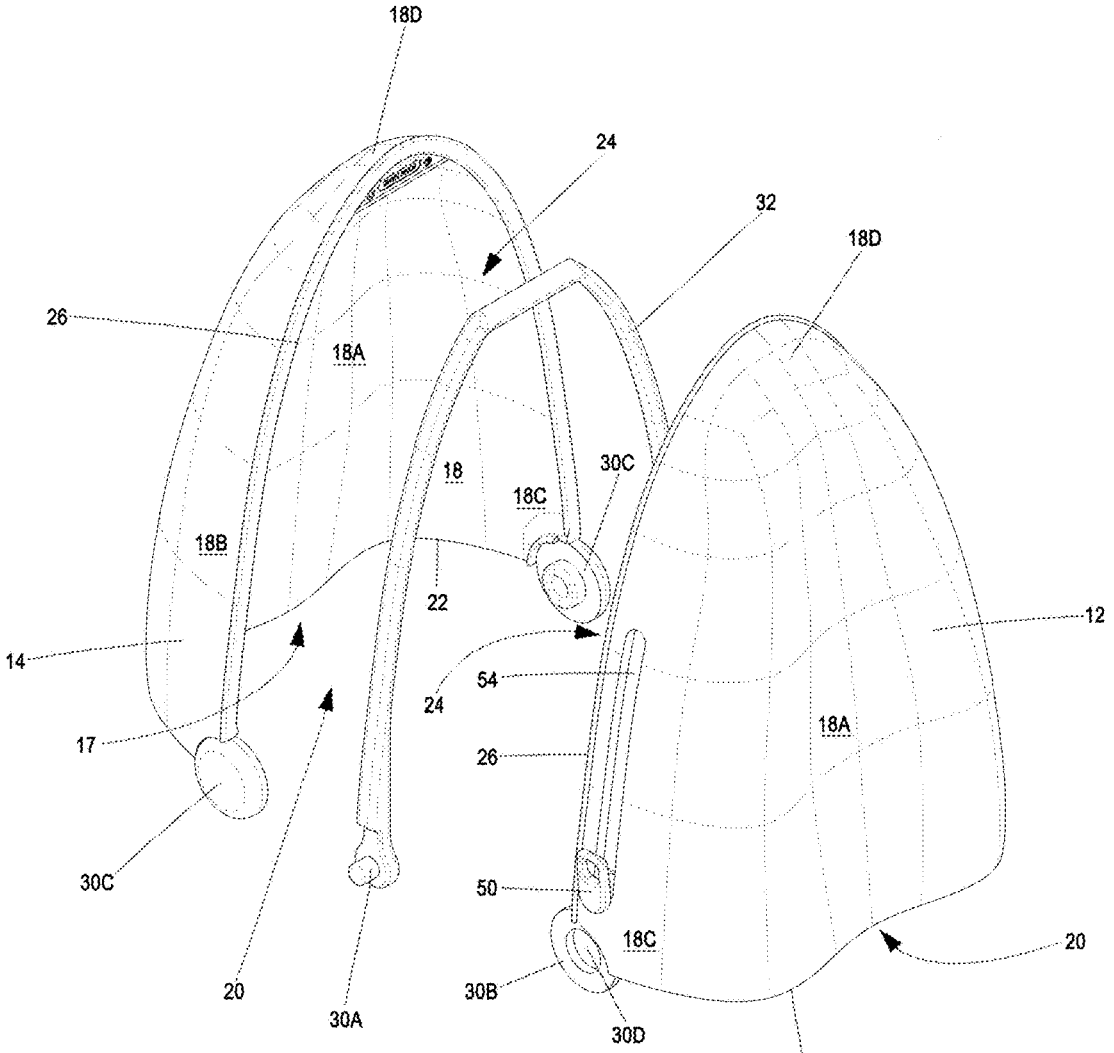
FIG. 2 is an exploded perspective view of the shell members of the device of FIG. 1.

With reference now also to FIG. 2, each of the shell member 12, 14 define a cavity 17 delimited by walls 18 thereof, an open end 20 being defined by first peripheral edges 22 of the wads 18 of the shell members 12, 14 and an open side 24 defined by second peripheral edges 26 of the walls 18 of the shell members 12, 14.

It will be appreciated that the shell members 12, 14 may be shaped in many different ways. In the illustrated embodiment thereof, the shell members 12, 14 each comprise a base wall 18A, opposing sidewalls 18B, 18C extending outwardly from the base wall 18A, an end wall 18D extending outwardly from the base wall and located between the opposing sidewalls, with the cavity 16 being delimited by the aforementioned walls 18A-D, as well as the open end 20 and the open side 24 positioned adjacently with respect to one another.

In this configuration, it will be appreciated that the first peripheral edges 22 coincide with the edges of the sidewalls 18B, 180 and the base wall 18A jointly, with the second peripheral edges 26 coinciding with the edges of the sidewalls 18B, 18C and end wall 18D jointly.

Furthermore, the walls 18A-D of the shell members 12, 14 are integral with one another and blended into each other to form a curving, rounded and flowing form.

Figure 3:
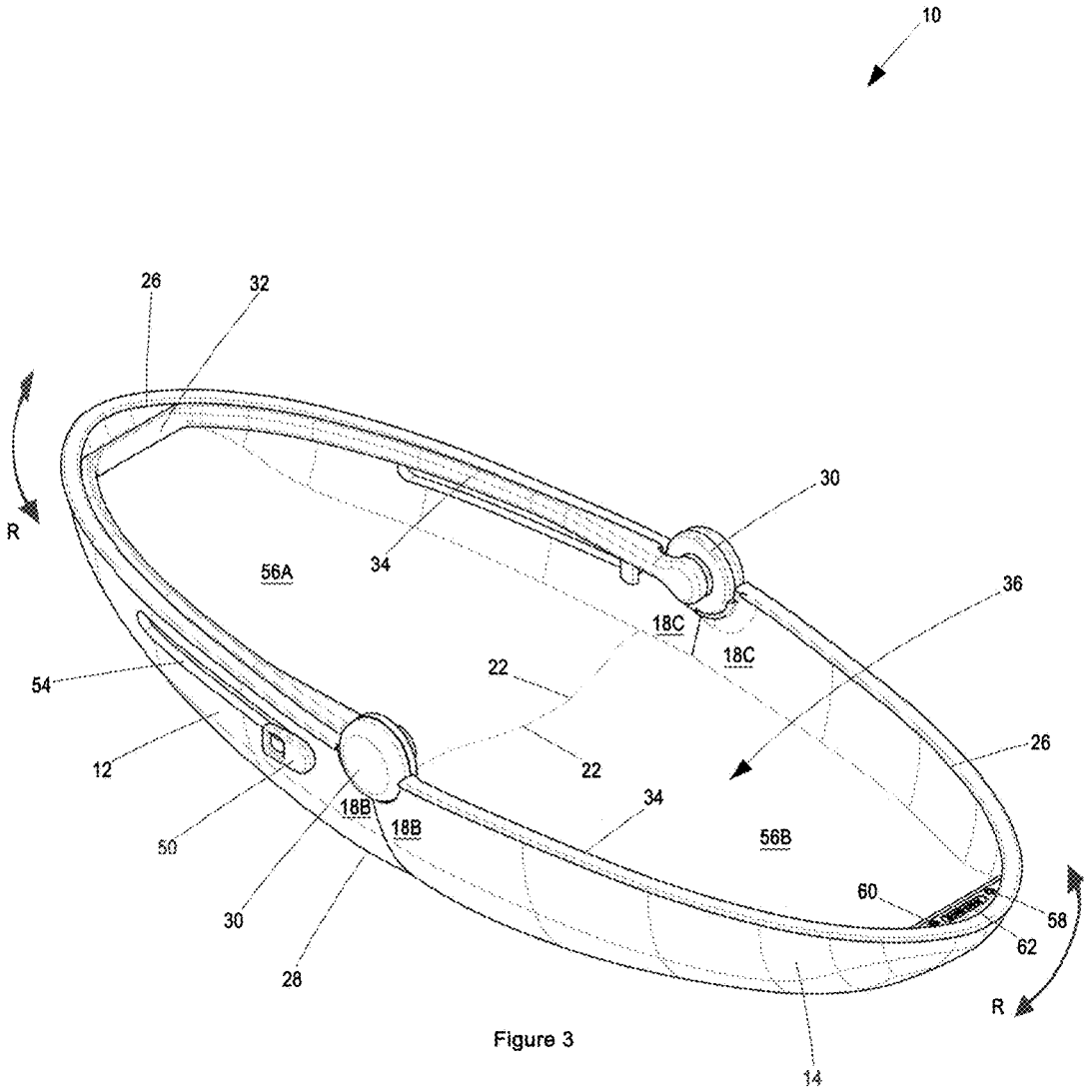
FIG. 3 is a perspective view of the device illustrated in an open baby carrier condition.
Figure 6:
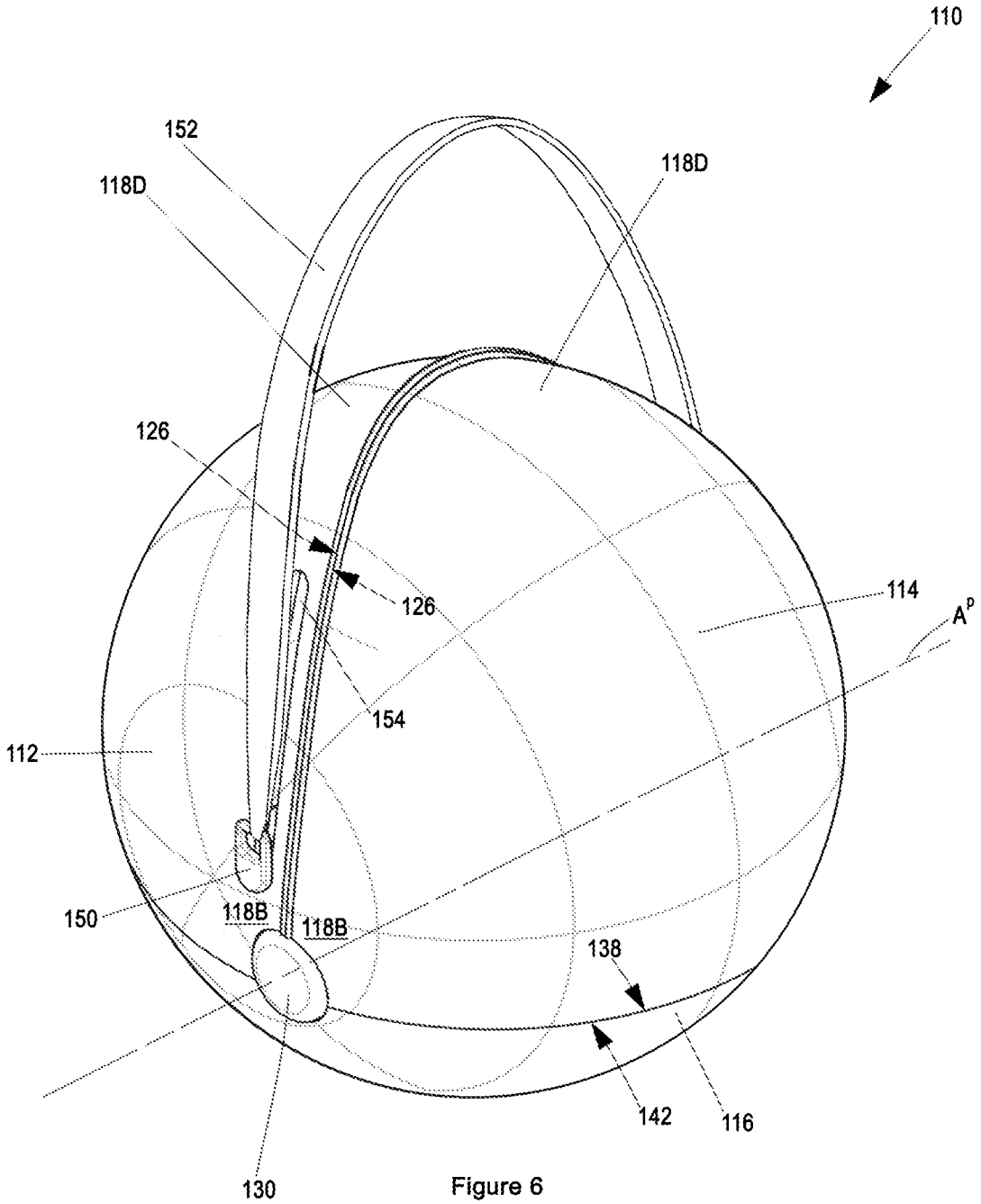
FIG. 6 is a perspective view of an alternative embodiment of a device convertible between a baby carrier and a case in accordance with the present invention, illustrated with the device in a closed case condition.
Figure 7:
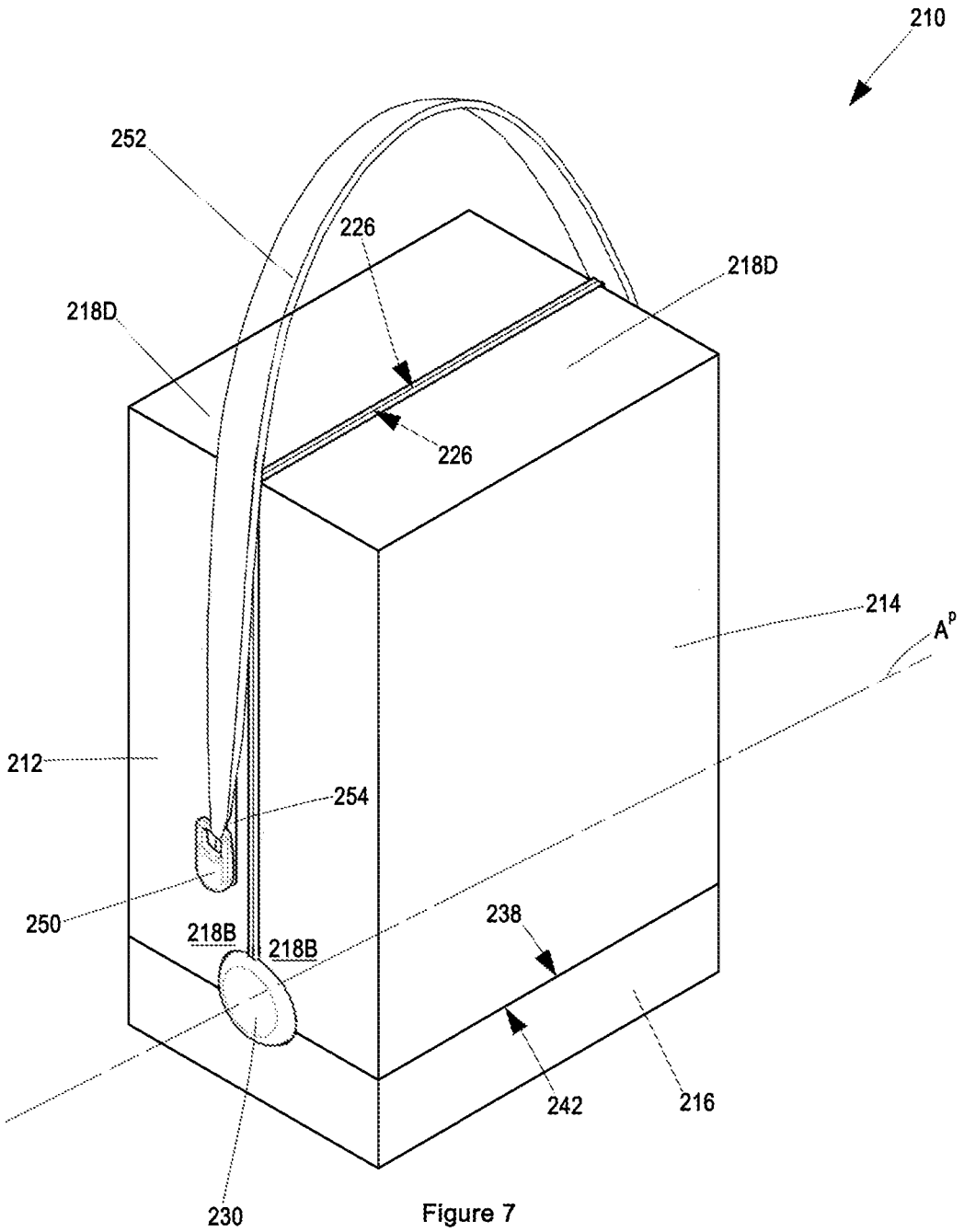
FIG. 7 is a perspective view of a yet further alternative embodiment of a device convertible between a baby carrier and a case in accordance with the present invention, illustrated with the device in a closed case condition.

Preferably, the each of the shell members 12, 14 are shaped to substantially resemble a quarter of a hollowed ellipsoid such that in an open baby carrier condition as depicted in FIG. 3, the device 10 comprises a substantially convex operatively bottom support surface 28 on which the device 10 can in use rock as shown by arrows "R" thereby to lull a baby to sleep. It will be appreciated that the shape of each of the shell members may be other than a quarter of a hollowed ellipsoid, For example, and as illustrated in FIG. 6 and FIG. 7, each of the shells may be respectively shaped to substantially resemble a quarter of a hollowed sphere or a hollowed cuboid. The reference numerals for FIGS. 6 and 7 begin with the prefix "1" or "2", respectively, with like suffixes among FIGS. 1, 6, and 7 designating like components, though distinctly shaped as illustrated. Accordingly, the reference numbers for FIGS. 6 and 7 should be considered in view of the reference numbers described in relation to FIG. 1.

Figure 4:
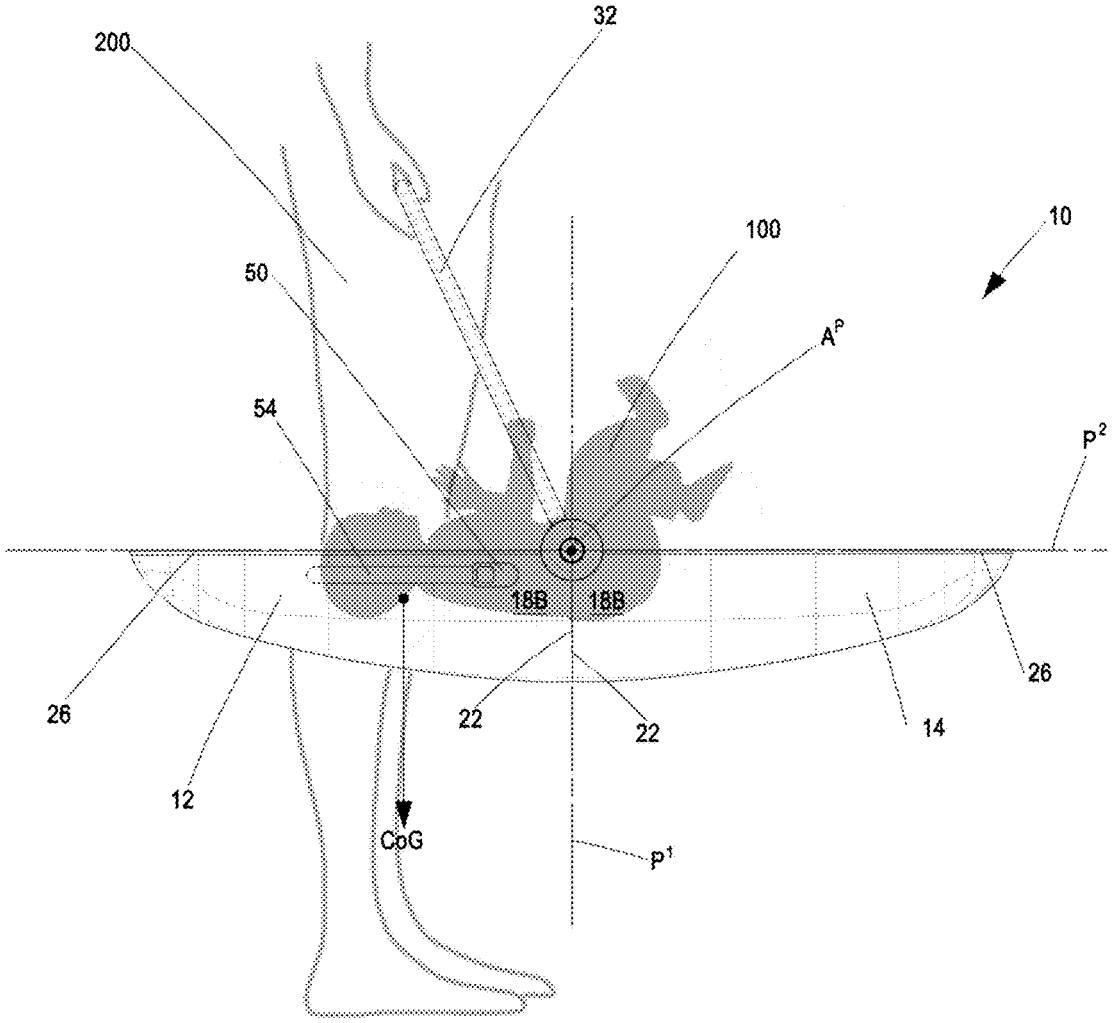
FIG. 4 is a side view of the device in the open baby carrier condition and being carried by a parent in use.

With reference now also to FIG. 4, the first peripheral edges 22 of each of the shell members 12, 14 lie on a first plane "$P^1$" with the second peripheral edges 26 lying on a second plane "$P^2$", being transversally and preferably perpendicularly orientated relative to the first plane "$P^1$".

Figure 5:
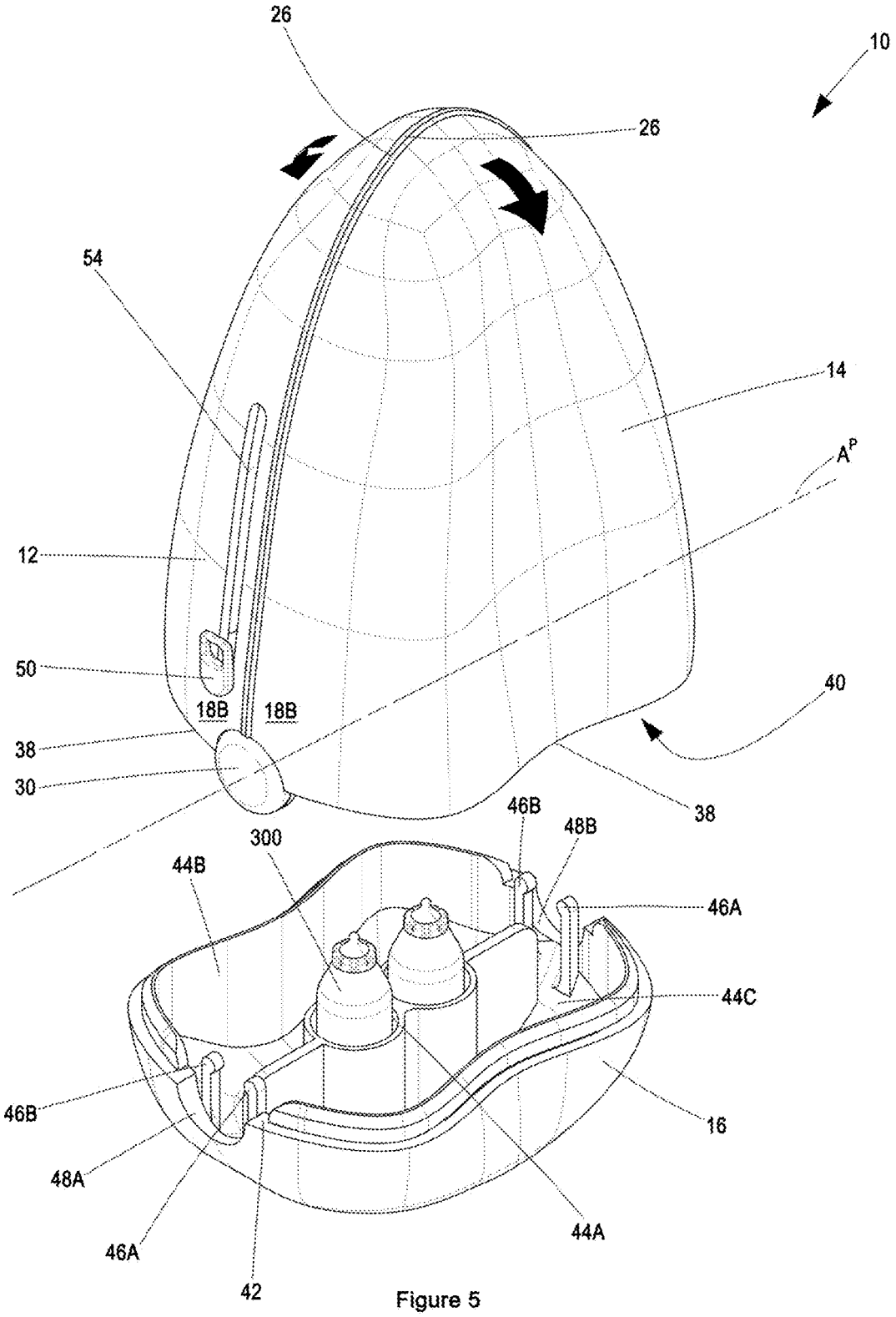
FIG. 5 is a perspective view of the device of FIG. 1 with a closure member removably spaced from pivotally connected shell members of the device.

The shell member 12, 14 are angularly displaceable relative to one another, in a clam-like fashion, about pivot axis "$A^P$" passing across the opposing sidewalls 18B of the shell members 12, 14 and lying substantially at or near the intersection of the first and second planes "$P^1$", "$P^2$" as illustrated in FIGS. 1, 2 and 5.

The shell members 12, 14 are pivotally connected to one another by first and second pivot connections 30 at each of the opposing sidewalls 18B thereof. With reference again to FIG. 2, each of the pivot connections 30 include a pivot pin 30A, a pair of first pivot formation 30B extending from each of the opposing sidewalls 18B of one of the shell members 12 and a pair of second pivot formations 30C extending from each of the opposing sidewalls 18B of the other of the shell members 14.

The first pivot formations 30B each define an aperture 30D for receiving the pivot pin 30A there through. The second pivot formations 30C are adapted to capture free ends of the pivot pins 30A passing through the apertures 30D defined in the respective first pivot formation 30B thereby to enable the shell members 12, 14 to angularly displace relative to one another about the pivot pins 30A.

As illustrated in FIG. 2, the free ends of the pivot pins 30A point outwardly from the device 10 in opposite directions, with inwardly pointed opposite ends of the pivot pins 30A connected to one another by a handle 32, the handle 32 being movable relative to either of the shell members 12, 14 between a first position and a second position.

In the first position, the handle 32 is angularly displaceable to lie substantially inside one of the shell members 12 and adjacent the second peripheral edge 26 thereof as depicted in FIG. 3. In the second position, the handle 32 is angularly displaceable away from the second peripheral edges 26 of the shell members 12, 14 as depicted in FIG. 4.

The handle 32 is releasably lockable at any angle substantially between 0 and 90 degrees relative to any one of the shell members 12. In this manner, and as depicted in FIG. 4, the handle 32 is capable of being locked in use over the centre of gravity "CoG" of the device 10 with a baby 100 positioned therein. This feature enables a parent 200 to carry the baby 100 in the device 10 in a substantially horizontal orientation such that the baby 100 is comfortable therein.

It will be appreciated that the handle may be locked in any position relative to the shell member 12, 14 in many difference ways, but preferably through a friction lock mechanism.

With reference now to FIGS. 1 and 3, the device 10 is angularly displaceable between an open baby carrier condition (FIG. 3) and a closed case condition (FIG. 1).

In the open baby carrier condition, the open ends 20 of the shell members 12, 14 lie substantially end-to-end relative to one another with the first peripheral edges 22 of each of the shell members 12, 14 substantially abutting each other. The second peripheral edges 26 of the shell members 12, 14 jointly form a primary substantially closed loop peripheral edge 34 defining a primary opening 36 through which the a baby 100 is operatively receivable in the device 10.

It will be appreciated that the device 10 preferably also includes means for releasably locking the shell members 12,14 to one another in the open baby carrier condition.

In the closed case condition, the open sides 24 of the shell members 12, 14 lie substantially side-to-side relative to one another with the second peripheral edges 26 of each of the shell members 12, 14 substantially abutting each other. With reference now also to FIG. 5, the first peripheral edges of the shell members 12, 14 jointly form a secondary substantially closed loop peripheral edge 38 defining a secondary opening 40 in which the closure member 16 is releasably connectable thereby to lock the shell members 12, 14 in the closed case condition.

With reference specifically to FIG. 5, the closure member 16 comprises a tertiary substantially closed loop peripheral edge 42 adapted to abut the secondary substantially closed loop peripheral edge 38 of the shell members 12, 14 with the closure member 16 received in the secondary opening 40 in the closed case condition of the device 10 as depicted in FIG. 1.

The closure member 16, further than being a member to lock the shell members 12, 14 in the closed case condition, doubles up as a storage unit defining a plurality of storage compartments 44A, 44B, 440 for storing feeding bottles 300, nappies and any other accessories respectively.

In an embodiment of the invention, the storage compartments 44A for storing feeding bottles 300 may be insulated to keep the feed contained in such feeding bottles 300 warm for as long as possible.

Although not shown, some of the compartments may comprise closures for opening and/or closing the respective compartment.

The closure member 16 defines a pair of snap fit connecting formations 46 for engaging the first and second pivot connections 30 thereby to releasably connect the closure member 16 in the secondary opening 40.

The snap fit connecting formations 46 are spaced apart from one another across the closure member 16 and comprise first and second connecting arms 46A, 46B, with each of the respective connecting arms 46A, 46B having free ends for engaging the respective pivot connections 30.

The closure member 16 defines a pair of opposing recesses 48A, 48B therein to at least partially accommodate the pivot connections 30 with the closure member 16 connected within the secondary opening 40.

At least the shell member 12 comprises attachment formations 50 on each of its opposing sidewalls 18B, 18C for attaching a strap-like handle 52 thereto as illustrated in FIG. 1.

The attachment formations 50 are captured within and capable of riding along slots 54 defined in the opposing sidewalls 18B, 18C of the shell member 12 such that the strap-like handle 52 is configurable relative to the device 10 between an inoperable position and an operable position.

In the inoperable position, the attachment formations 50 are movable towards the pivot axis "$A^P$" such that the strap-like handle 52 is pulled towards and/or against the shell member 12.

In the operable position, the attachment formations 50 are movable away from the pivot axis "$A^P$" such that a space is defined between a looped end of the strap-like handle 52 and the end walls 18D of the shell members 12, 14 thereby enabling a user 200 (i.e. the parent) to carry the device 10, in the closed case condition, over his/her shoulder.

It will be appreciated that although the attachment formations 50 may simply fall toward the pivot axis "$A^P$" under the force of gravity with the device 10 standing in an operatively upright condition as depicted in FIG. 1, it may be preferable that they are biased toward the pivot axis "$A^P$" by, for example, a spring.

With reference specifically to FIG. 3, and for receiving the baby 100 comfortably in the device 10 in the open baby carrier condition, inner surfaces of the shell members 12, 14 are at least partially laid with bedding material 56A, 56B.

It is envisaged by the inventor that the device 10 as described above may be retailed as a standard version. Upgraded versions of the device 10 may be sold at a premium with any one or more of the additional features that will now be described.

A first possible additional feature is the inclusion of a means for generating a rocking motion "R" with the device 10 in the open baby carrier condition. The rocking motion generating means (not shown) may be in the form of one or more weights being movable across the device 10 in the open baby carrier condition substantially between the opposing end walls 18D of the shell members 12, 14.

The rocking motion generating means will enable a rocking motion "R" to be imparted to the device 10 without the parent 200 from physically having to impart such motion to the device 10.

A second possible additional feature is the inclusion of one or more speakers (not shown) for playing music from a built-in audio player or from an external audio player to which the device 10 is connectable via hardwire or wirelessly. Where the audio player is connectable by hardwire, the device 10 will include a port 58 for receiving a corresponding jack to connect the audio player to the device 10.

A third possible additional feature is the inclusion of a means of heating those storage compartments 44A is which the feeding bottles 300 may be stowed thereby to bring the temperature of the feed contained in such feeding bottled 300 to the required temperature.

For any of these additional features to be included in the device 10, the device 10 requires an on-board power supply (not shown) for powering the additional features, which power supply will need to be re-charged from time-to-time.

Re-charging of the power supply will be capable via one or more re-charge ports 60 through which the device 10 can be plugged into a power source (i.e. the mains of a domestic home) or through an induction re-charging mechanism.

It will be appreciated that a controller will be required for controlling at least the speed of the rocking motion "R", the volume of audio play and the temperature of the storage compartments 44A.

The controller may be a built-in control panel 62 or an external control device. It is envisaged that the external audio player and the external control device are one and the same device, in the form of a mobile communications device interfaced with the device 10 via a downloadable software application, which is capable of wirelessly communicating with the device 10 via Bluetooth, a wireless hotspot or any other applicable wireless communications platform.

Although the device 10, in the closed case condition and with the closure member 16 received within the secondary opening 40 as illustrated in FIG. 1, may take many different shapes, it is preferable that the device 10 is substantially ovoid (i.e. egg-shaped) in shape.

Although the invention has been described above with reference to preferred embodiments, it will be appreciated that many modifications or variations of the invention are possible without departing from the spirit or scope of the invention.

For example, non-slip contact areas may be incorporated into or onto the external surfaces of the shell members 12, 14 on which the device 10, in the open baby carrier condition, normally stands. These non-slip contact areas may be rubberised.

Another example is the inclusion of a flat bedding support member, spaced from the base wall 18A and located within the cavity 17 of each of the shell members 12, 14, on which the bedding material 56A, 56B is supportable in use.

The invention claimed is:

1. A device convertible between a baby carrier and a case including:

a pair of shell members each defining:

(i) a cavity delimited by walls of the respective shell member;

(ii) an open end being defined by first peripheral edges of the walls of the respective shell member;

(iii) and an open side defined by second peripheral edges of the walls of the shell member;

wherein the open end and the open side of each of the shell members are adjacent one another, and further wherein the shell members are angularly displaceable relative to one another between:

an open baby carrier condition, wherein the first peripheral edges defining the open ends of the shell members substantially abut one another through their length with the shell members lying substantially end-to-end relative to one another such that the second peripheral edges of the shell members jointly form a primary substantially closed loop peripheral edge defining a primary opening through which a baby is operatively receivable in the device in the baby carrier condition; and a closed case condition, wherein the open sides of the shell members lie substantially side-to-side relative to one another such that the first peripheral edges of the shell members at least partially separate from one another to jointly form a secondary substantially closed loop peripheral edge defining a secondary opening; and a closure member movable relative to the shell members in the closed case condition between a removably spaced condition, wherein the closure member is withdrawn and detached from the secondary opening, and a releasably connectable condition, wherein the closure member is at least partially received within the secondary opening between the shell members thereby to lock the shell members in the closed case condition.

2. The device according to claim 1, wherein the shell members are shaped to substantially resemble a quarter of a hollowed sphere.

3. The device according to claim 1, wherein the cavity of each of the shell member is delimited by: (i) a base wall; (ii) opposing sidewalls extending outwardly from the base wall, (iii) an end wall extending outwardly from the base wall and located between the opposing sidewalls; (iv) the open end substantially opposite the end wall, wherein the first peripheral edges defining the open end are those of the sidewalls and the base wall jointly; and (v) an open side substantially opposite the base wall, wherein the second peripheral edges defining the open side are those of the sidewalls and end wall jointly.

4. The device according to claim 3, wherein the base wall, opposing sidewalls and/or the end wall are integral with one another, and further wherein each of the shell members are shaped to substantially resemble a quarter of a hollowed cuboid.

5. The device according to claim 4, wherein the base wall, opposing sidewalls and/or the end wall are blended into one another to provide the shell members with a curving, rounded and flowing form such that in the open baby carrier condition, the device comprises a convex operatively bottom support surface on which the device can in use rock to lull a baby to sleep, characterized in that each of the shell members are shaped to substantially resemble a quarter of a hollowed ellipsoid.

6. The device according to claim 5, wherein the device, with the shell members in the closed case condition and with the closure member connected within the secondary opening, is substantially ovoid in shape, characterized in that in the open baby carrier condition, the first peripheral edges of the shell members are at least one of within close proximity of one another and abut, and further wherein, in the closed case condition, the second peripheral edges of the shell members are at least one of within close proximity of one another and abut.

7. The device according to claim 6 including means for releasably locking the shell members to one another in the open baby carrier condition.

8. The device according to claim 7, wherein the first peripheral edges of each of the shell members lie on a first plane with the second peripheral edges lying on a second plane, the first and second planes being transversally orientated relative to one another.

9. The device according to claim 8, wherein the first and second planes are orientated substantially perpendicularly relative to one another, the shell members being angularly displaceable relative to one another about a pivot axis passing across the opposing sidewalls of the shell members and lying substantially at or near an intersection of the first and second planes.

10. The device according to claim 9, wherein the shell members are pivotally connected to one another by first and second pivot connections at each of the opposing sidewalls thereof.

11. The device according to claim 10, wherein each of the pivot connections includes:

a pivot pin;

a pair of first pivot formations extending from each of the opposing sidewalls of one of the shell members, each of the first pivot formations defining an aperture for receiving the pivot pin; and a pair of second pivot formations extending from each of the opposing sidewalls of the other of the shell members, each of the second pivot formations adapted to capture a free end of the pivot pin passing through the respective first pivot formation thereby to enable the shell members to pivot with respect to one another about the pivot pins.

12. The device according to claim 11, wherein the free ends of the pivot pins are pointed outwardly from the device in opposite directions, with inwardly pointed opposite ends thereof connected to one another by a handle, the handle being movable relative to either of the shell members between a first position, wherein the handle is angularly displaceable to lie substantially adjacent the second peripheral edge of one of the shell members, and a second position, wherein the handle is angularly displaceable away from the second peripheral edges of the shell members.

13. The device according to claim 12, wherein the handle in the first position lies over or inside of the second peripheral edge of the respective shell member.

14. The device according to claim 13, wherein the second position of the handle is substantially perpendicular to the second plane, the handle being releasably lockable at a plurality of angles relative to the second plane.

15. The device according to claim 14, wherein at least one of the shell members comprises attachment formations on each of the opposing sidewall thereof for attaching a strap-like handle thereto.

16. The device according to claim 15, wherein the attachment formations are captured within and capable of riding along slots defined in the opposing sidewalls such that the strap-like handle is configurable relative to the device between an inoperable position, wherein the attachment formations are movable towards the pivot axis such that the strap-like handle is pulled towards and/or against the shell member, and an operable position, wherein the attachment formations are movable away from the pivot axis such that a space is defined between a looped end of the strap-like handle and the end walls of the shell members thereby enabling a user to carry the device, in the closed case condition, over his/her shoulder.

17. The device according to claim 16, wherein the attachment formations are biased toward the inoperable position, and further wherein inner surfaces of the shell members are at least partially laid with bedding material.

18. The device according to claim 17, wherein the closure member comprises a tertiary substantially closed loop peripheral edge adapted to abut the secondary substantially closed loop peripheral edge of the shell members in the closed case condition, the closure member defining a plurality of storage compartments for storing feeding bottles, nappies and any other accessories, characterized in that the one or more of the plurality of storage compartments comprise closures for at least one of opening and closing the respective compartment, and are insulated for keeping feeding bottles at the required temperature.

19. The device according to claim 18, wherein the closure member defines snap fit connecting formations for engaging the first and second pivot connections thereby to releasably connect the closure member in the secondary opening, the snap fit connecting formations being first and second pairs of connecting arms spaced from one another across the closure member, the connecting arms of each respective pair having free ends for engaging the respective pivot connections, characterized in that the closure member defines a pair of opposing recesses therein to at least partially accommodate the pivot connections with the closure member connected within the secondary opening.

* * * * *